US011547895B1

(12) United States Patent
Wang

(10) Patent No.: US 11,547,895 B1
(45) Date of Patent: Jan. 10, 2023

(54) MULTIFUNCTIONAL CHAIR

(71) Applicant: NAN YA PLASTICS CORPORATION, Taipei (TW)

(72) Inventor: Kuei-Yung Wang, Taipei (TW)

(73) Assignee: NAN YA PLASTICS CORPORATION, Taipei (TW)

( * ) Notice: Subject to any disclaimer, the term of this patent is extended or adjusted under 35 U.S.C. 154(b) by 0 days.

(21) Appl. No.: 17/835,927

(22) Filed: Jun. 8, 2022

(30) Foreign Application Priority Data

May 9, 2022 (TW) ..... 111204731

(51) Int. Cl.

| | |
|---|---|
| ***A63B 21/00*** | (2006.01) |
| ***A47C 9/00*** | (2006.01) |
| ***A63B 21/02*** | (2006.01) |
| ***A63B 21/04*** | (2006.01) |
| ***A63B 21/05*** | (2006.01) |

(52) U.S. Cl.
CPC ..... *A63B 21/4031* (2015.10); *A47C 9/002* (2013.01); *A63B 21/023* (2013.01); *A63B 21/0428* (2013.01); *A63B 21/05* (2013.01); *A63B 21/4033* (2015.10);
(Continued)

(58) Field of Classification Search
CPC ..... A63B 21/00178; A63B 21/002; A63B 21/0023; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/05; A63B 21/0552; A63B 21/0555; A63B 21/0557; A63B 21/15; A63B 21/159; A63B 21/4027; A63B 21/4029; A63B 21/4031; A63B 21/4033; A63B 21/4034; A63B 21/4035; A63B 21/4047; A63B 21/4049; A63B 23/035; A63B 23/03508; A63B 23/03516; A63B 23/03533; A63B 23/03541; A63B 23/0355; A63B 2208/0204; A63B 2208/0228;
(Continued)

(56) References Cited

U.S. PATENT DOCUMENTS 5,044,633 A * 9/1991 Rice ..... A63B 21/055 482/130
6,634,997 B2 * 10/2003 Breibart ..... A63B 21/1609 482/130

(Continued)

*Primary Examiner* — Gary D Urbiel Goldner
(74) *Attorney, Agent, or Firm* — Li & Cai Intellectual Property Office

(57) ABSTRACT

A multifunctional chair is provided. The multifunctional chair includes a supporting body, a telescopic structure, a seat body, and a pedal assembly. The pedal assembly includes a fixing rod, a movable rod, an operation portion, and an elastic resistance member. The telescopic structure is connected to the supporting body and configured to be operated to telescopically move relative to the supporting body. One end of the fixing rod is fixed to the supporting body. The movable rod is movably connected to the fixing rod. The operation portion is arranged at an end of the movable rod away from the fixing rod. Two ends of the elastic resistance member are respectively connected to the supporting body and the fixing rod. A user can push against the operation portion to rotate the movable rod and the fixing rod toward the ground, and the elastic resistance member provides an elastic resistance.

10 Claims, 12 Drawing Sheets

(52) U.S. Cl.
CPC ..... *A63B 2208/0204* (2013.01); *A63B 2208/0233* (2013.01); *A63B 2225/093* (2013.01)

(58) Field of Classification Search
CPC ..... A63B 2208/0233; A63B 2225/09; A63B 2225/093
See application file for complete search history.

(56) References Cited

U.S. PATENT DOCUMENTS

| | | | | |
|---|---|---|---|---|
| 7,445,586 | B2 * | 11/2008 | Gibson | A63B 23/0494 482/148 |
| 8,613,692 | B2 * | 12/2013 | Baudhuin | A63B 21/023 482/121 |
| 11,324,990 | B2 * | 5/2022 | Clark | A63B 23/03541 |
| 2007/0037677 | A1 * | 2/2007 | Splane, Jr. | A63B 21/4047 482/121 |
| 2009/0197746 | A1 * | 8/2009 | Splane, Jr. | A63B 22/0056 482/121 |
| 2009/0264266 | A1 * | 10/2009 | Solow | A63B 21/023 482/130 |

* cited by examiner

MULTIFUNCTIONAL CHAIR

CROSS-REFERENCE TO RELATED PATENT APPLICATION

This application claims the benefit of priority to Taiwan Patent Application No. 111204731, filed on May 9, 2022. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a multifunctional chair, and more particularly to a multifunctional chair that allows a user to engage in exercise thereon.

BACKGROUND OF THE DISCLOSURE

A conventional office chair does not provide for a user to engage in exercise on the chair.

SUMMARY OF THE DISCLOSURE

In response to the above-referenced technical inadequacy, the present disclosure provides a multifunctional chair to improve on a conventional office chair that does not have a function of allowing a user to engage in exercise therewith.

In one aspect, the present disclosure provides a multifunctional chair. The multifunctional chair includes a supporting body, a telescopic structure, a seat body, and at least one pedal assembly. The supporting body includes a placement portion. The placement portion is configured to be placed on the ground. The telescopic structure is movably connected to the placement portion. The telescopic structure is configured to move relative to the supporting body in a direction away from the supporting body or in a direction toward the supporting body. The seat body is fixed to a fixing portion of the supporting body. The at least one pedal assembly includes a fixing rod, a movable rod, an operation portion, and an elastic resistance member. The fixing rod has one end pivotally connected to the supporting body. The movable rod is movably connected to the fixing rod. The movable rod is configured to move relative to the fixing rod. The operation portion is disposed at one end of the movable rod away from the fixing rod. The elastic resistance member has two ends respectively fixed to the supporting body and the fixing rod. The operation portion is configured to be operated, so that the movable rod and the fixing rod are configured to rotate relative to the supporting body, and the elastic resistance member is configured to provide an elastic resistance. The movable rod is configured to move relative to the fixing rod, so that the operation portion is stored away below the seat body, and the operation portion does not protrude from a front edge of the seat body. The at least one pedal assembly is configured to be disposed near the front edge of the seat body, so that the operation portion is provided to be abutted by the feet, a left hand, or a right hand of a user sitting on the seat body.

Therefore, by the design of the supporting body, the telescopic structure, and the pedal assembly, the multifunctional chair of the present disclosure can be not only be used as a normal office chair, but the user can also utilize the multifunctional chair to do exercise through simple operation.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
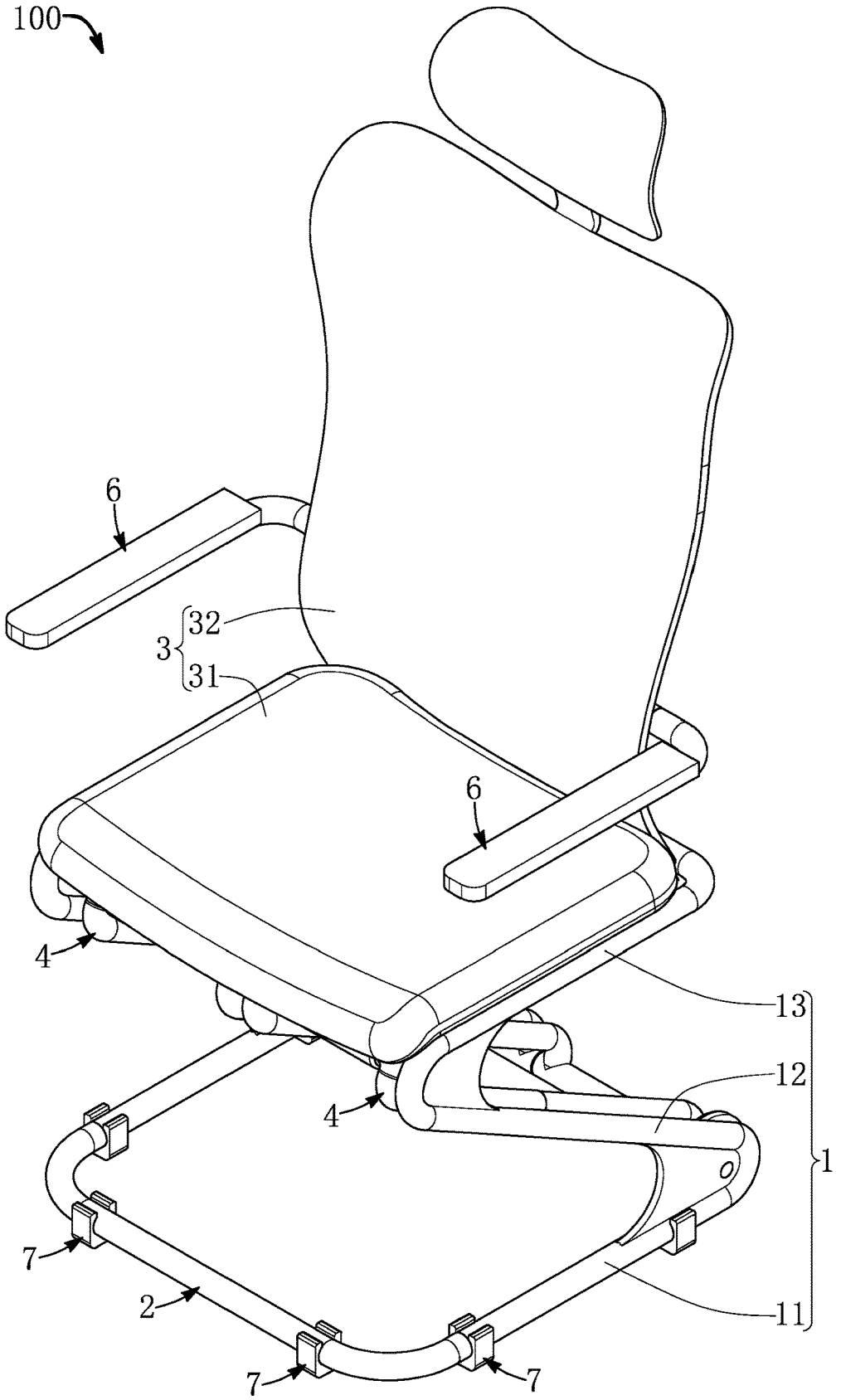
FIG. 1 to FIG. 3 are schematic views of a multifunctional chair from different angles according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
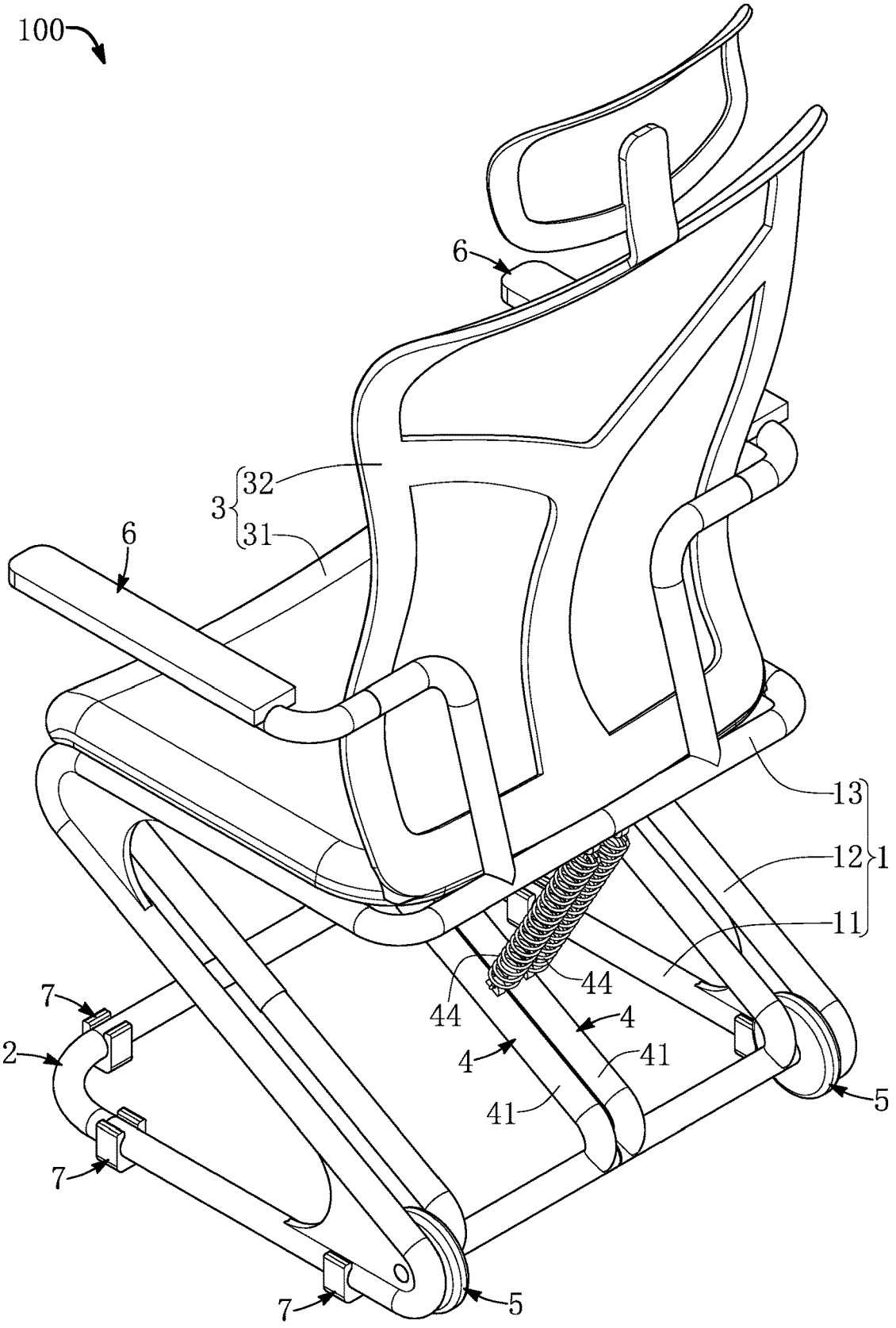
Figure 3:
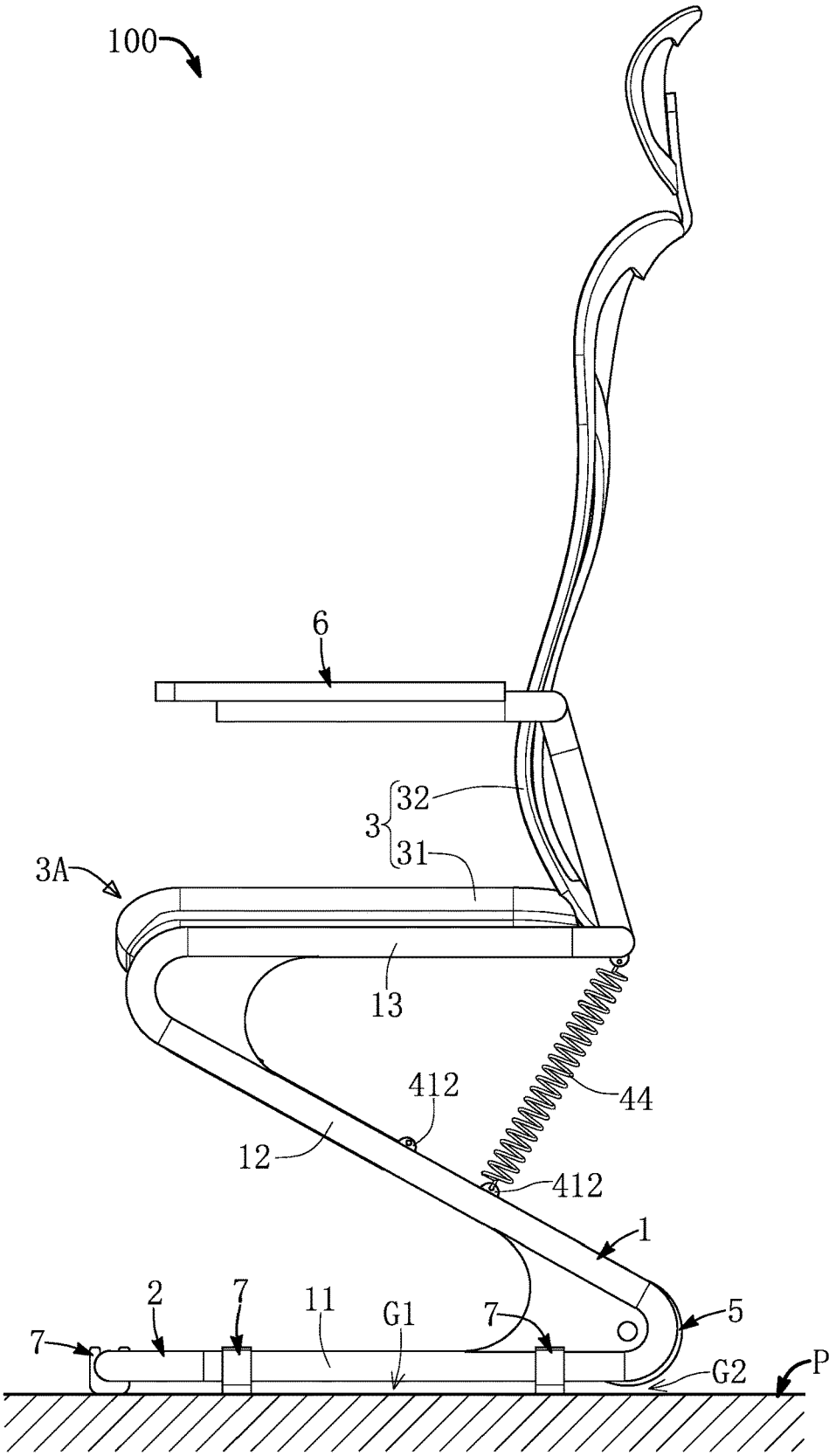
Figure 4:
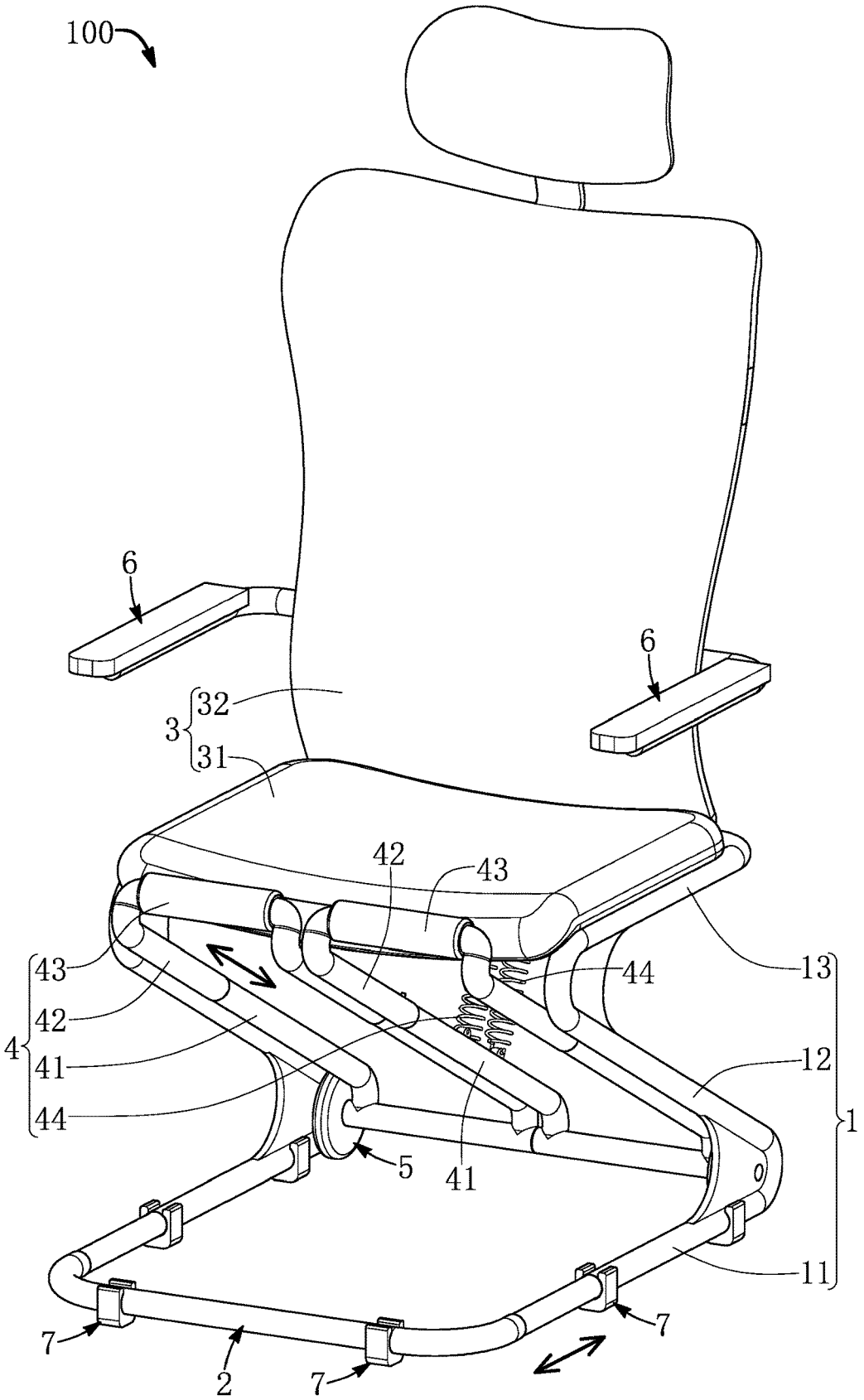
FIG. 4 and FIG. 5 are schematic views of a telescopic structure and a movable rod of the multifunctional chair that have been operated according to the present disclosure.

Referring to FIG. 1 to FIG. 4, FIG. 1 to FIG. 3 are schematic views of a multifunctional chair from different angles according to the present disclosure, and FIG. 4 is a schematic view of a telescopic structure and a movable rod of the multifunctional chair that have been operated according to the present disclosure. The multifunctional chair 100 of the present disclosure includes a supporting body 1, a telescopic structure 2, a seat body 3, two pedal assemblies 4, two auxiliary wheels 5, and two armrest structures 6. In other embodiments, the multifunctional chair 100 can include only one pedal assembly 4. In another embodiment, the multifunctional chair 100 can be provided to not include the auxiliary wheels 5.

The supporting body 1 includes a placement portion 11, two inclined rods 12, and a fixing portion 13. The placement portion 11 is configured to be placed on the ground. The placement portion 11 can be, for example, made of a plurality of rods, but the structure of the placement portion 11 and the components included by the placement portion 11 are not limited to those shown in the figures. Two ends of each of the inclined rods 12 are respectively connected to the placement portion 11 and the fixing portion 13. The quantity of the inclined rods 12 included by the supporting body 1 and the structure and the dimension of each of the inclined rods 12 are not limited to those shown in the figures. The placement portion 13 is configured to be fixed to the seat body 3. The fixing portion 13 is primarily configured to allow the seat body 3 to be stably connected to the supporting body 1, and accordingly, the structure and the dimension and the components included by the fixing portion 13 can be designed according to the structure and the dimension of the seat body 3.

Figure 5:
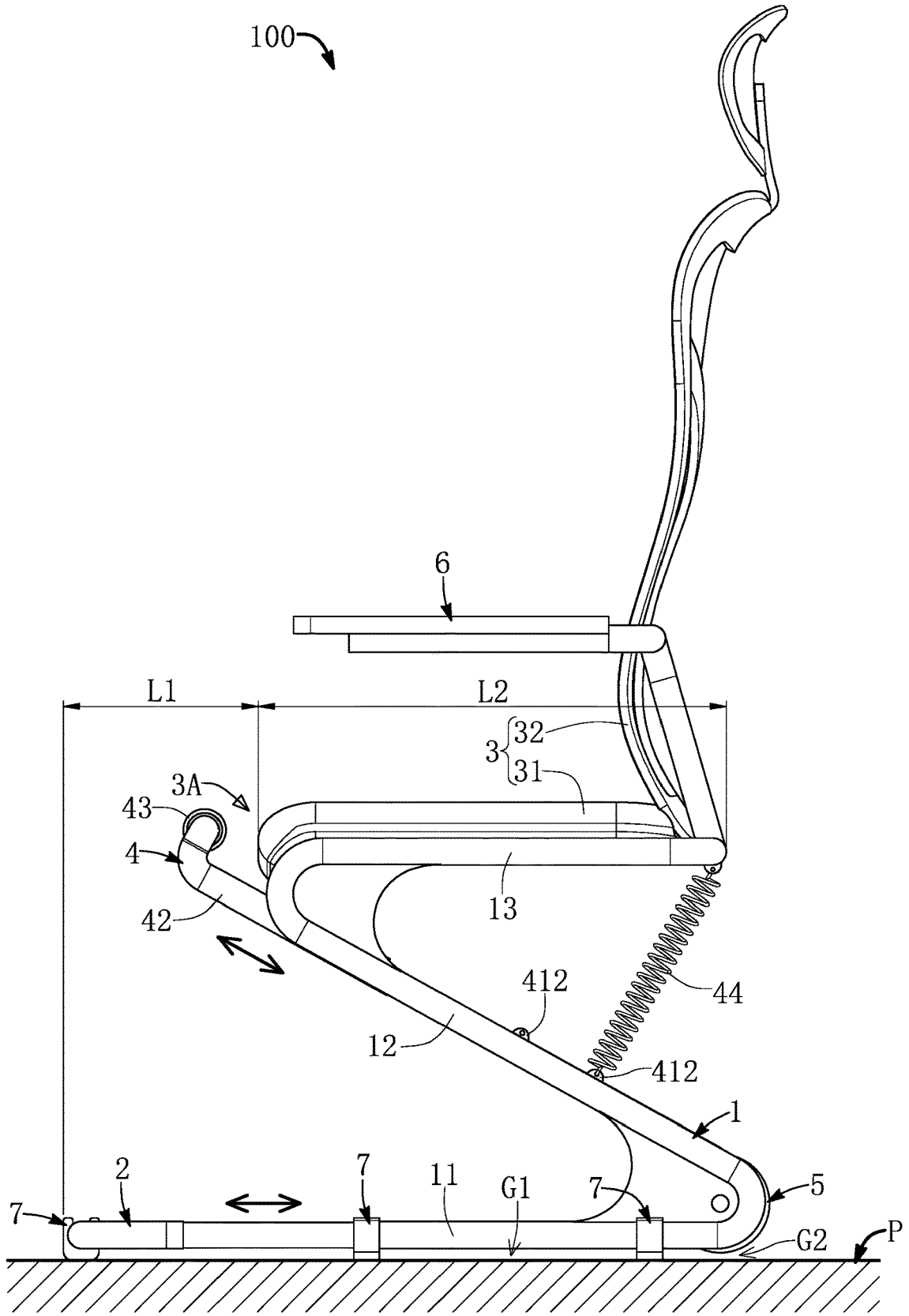
Figure 6:
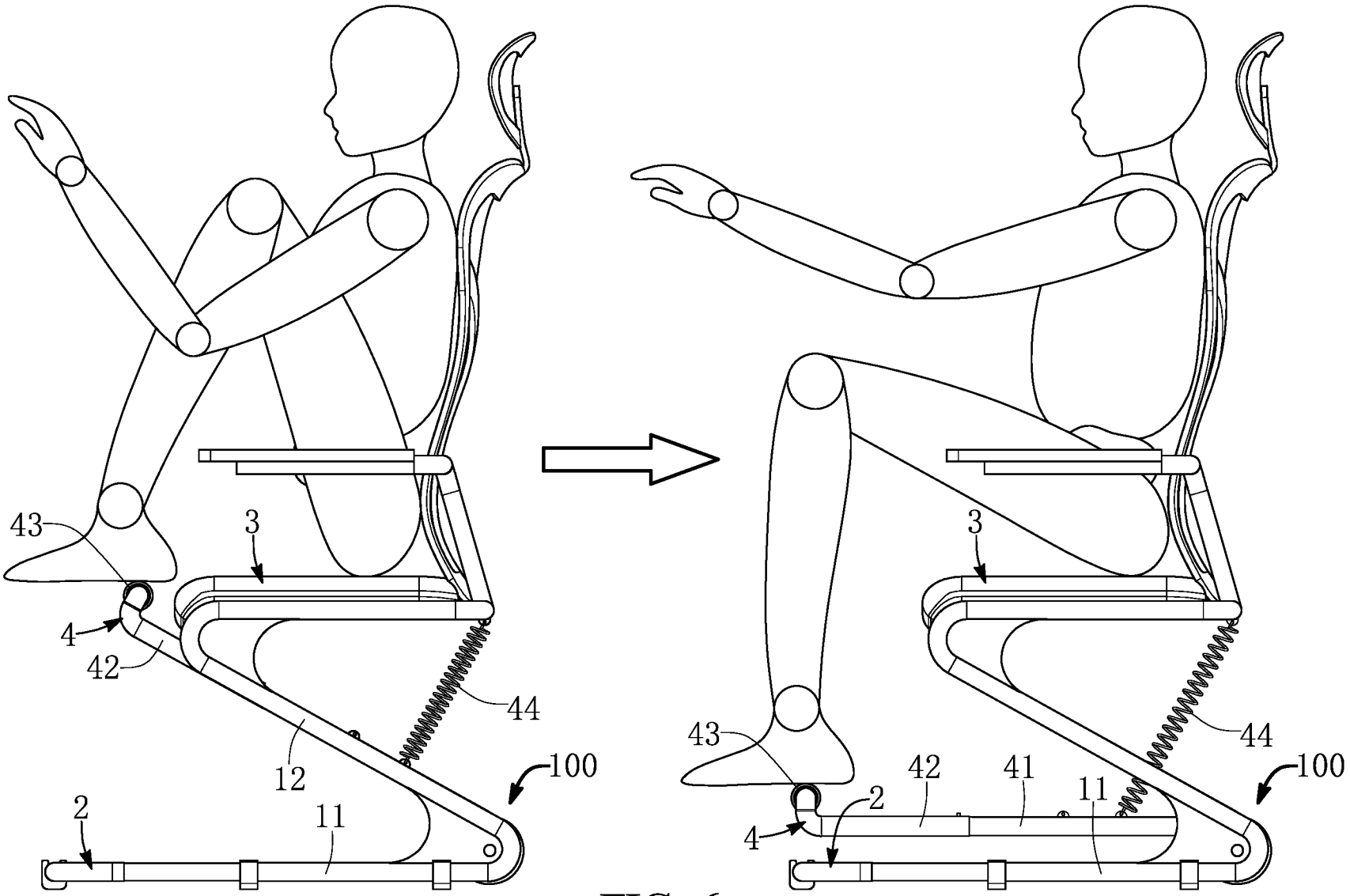
FIG. 6 is a schematic view showing a user utilizing the multifunctional chair to do exercise according to the present disclosure.

The telescopic structure 2 is movably connected to the placement portion 11, and the telescopic structure 2 can be operated to move relative to the placement portion 11 in a direction away from the supporting body 11 or in a direction toward the supporting body 11. More specifically, the telescopic structure 2 can be operated to move in the direction away from the supporting body 11, so as to protrude from a front edge 3A of the seat body 3 (as shown in FIG. 5 and FIG. 6). Or, the telescopic structure 2 can be operated to move in the direction toward the supporting body 11, so as to not protrude from the front edge 3A of the seat body 3 (as shown in FIG. 1 and FIG. 3).

In a practical application, the placement portion 11 can include two hollow tubes, the telescopic structure 2 can include two tubes, the two tubes of the telescopic structure 2 can be respectively disposed in the two hollow tubes of the placement portion 11, and when the telescopic structure 2 is operated, the two tubes of the telescopic structure 2 can move relative to the two hollow tubes. The practical manner in which the telescopic structure 2 and the placement portion 11 are connected to and fixed to each other is not limited to that shown in the figures. In an embodiment, the telescopic structure 2 can be fixed to the placement portion 11 through a plurality of screws, or the telescopic structure 2 can have two operation assemblies. When each of the operation assemblies is not operated, the telescopic structure 2 and the placement portion 11 are fixed to each other, and when the two operation assemblies are operated, the telescopic structure 2 moves telescopically relative to the placement portion 11.

The seat body 3 can include a seat board structure 31 and a backrest structure 32. A rear edge of the seat board structure 31 is connected to the backrest structure 32. The seat board structure 31 is configured to be sat upon by a user, and the backrest structure 32 is configured to be abutted against by the user's back. The seat board structure 31 is fixed to the fixing portion 13 of the supporting structure 1. The structure and the dimensions of the seat board structure 31 and the backrest structure 31 are not limited to those shown in the figures.

Referring to FIG. 1, and FIG. 3 to FIG. 6. FIG. 4 and FIG. 5 are schematic views of a telescopic structure and a movable rod of the multifunctional chair that have been operated according to the present disclosure, and FIG. 6 is a schematic view showing a user utilizing the multifunctional chair to do exercise according to the present disclosure. The two pedal assemblies 4 are connected to the supporting body 1. Each of the pedal assemblies 4 includes a fixing rod 41, a movable rod 42, an operation portion 43, and an elastic resistance member 44. In each of the pedal assemblies 4, one end of the fixing rod 41 is pivotally connected to the supporting body 1. The movable rod 42 is connected to the fixing rod 41 and is able to telescopically move relative to the fixing rod 41. The operation portion 43 is disposed at one end of the movable rod 42 away from the fixing rod 41. The operation portion 43 and the movable rod 42 connected thereto are substantially in a shape of the letter "T", but the present disclosure is not limited thereto. The operation portion 43 is primarily configured to be abutted by a sole or a palm of the user, and two ends of the elastic resistance member 44 are respectively fixed to the supporting body 1 and the fixing rod 41. The elastic resistance member 44 can be, for example, a stretching spring, but the present disclosure is not limited thereto. Any component that can elastically deform to provide elastic resistance should fall within the applicable scope of the elastic resistance member 44.

Each of the movable rods 42 can be operated to move relative to the fixing rod 41 connected thereto, so that each of the operation portions 43 can be stored away (e.g., tucked or hidden) below the seat body 3 or can protrude from the front edge 3A of the seat body 3. When the user operates the telescopic structure 2 and the two movable rods 42 to allow the telescopic structure 2 and the two operation portions 43 to protrude from the front edge 3A of the seat body 3, the user can utilize the multifunctional chair 100 to do muscle training exercises.

More specifically, as shown in FIG. 6, the user seating on the chair body 3 can apply force to the two operation portions 43 by the user's feet, so that the two operation portions 43 rotate relative to the supporting body 1 together with the movable rods 42 and fixing rods 41 connected to the operation portions 43, and the two elastic resistance members 44 are driven to be in a stretched state to provide the elastic resistance. In other words, when the user's feet are placed on the two operation portions 43, the user has to apply enough force to resist the elastic resistance provided by the two elastic resistance members 44, so that a muscle training effect can be achieved.

According to the above, when the user wishes to utilize the multifunctional chair 100 for muscle training, only a simple operation is needed to allow the two operation portions 43 and the telescopic structure 2 to protrude from the front edge 3A of the seat board structure 31, and enable the user to start exercising. After the user finishes exercising, only a simple operation is needed for the two operation portions 43 and the telescopic structure 2 to be re-positioned inwards and no longer protrude from the front edge 3A of the seat board structure 31, such that the multifunctional chair 100 can accordingly be used as a normal office chair.

It is worth mentioning that, by the design of the telescopic structure 2, the supporting body 1 is in contact with the ground P by a greater area, so as to prevent the multifunctional chair 100 from capsizing during exercise. In other words, without the telescopic structure 2 of the present disclosure, it is possible for the multifunctional chair 100 to capsize when being utilized for exercise, unless the multifunctional chair 100 itself possesses an extremely heavy weight.

In a preferable embodiment, after the telescopic structure 2 is operated, a length L1 of the telescopic structure 2 protruding from the front edge 3A of the seat body 3 is greater than or equal to one third of a length L2 of the seat board structure 31. Therefore, the multifunctional chair 100 can be effectively prevented from capsizing when the user is using the multifunctional chair 100, especially when an overall weight of the multifunctional chair 100 of an embodiment is relatively light.

Figure 7:
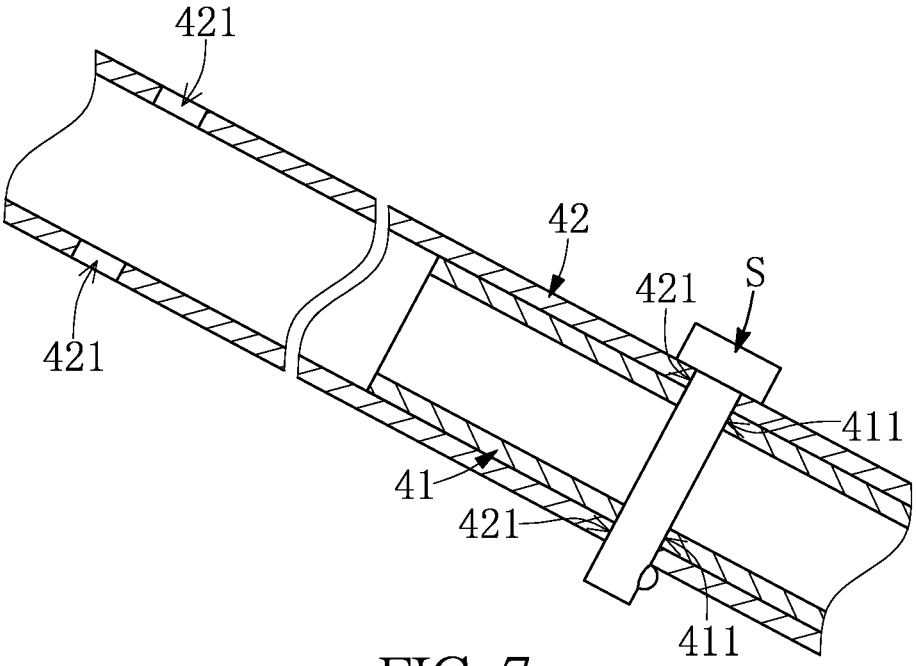
FIG. 7 is a partial sectional schematic view of the movable rod and a fixing rod of the multifunctional chair of the present disclosure.

As shown in FIG. 7, FIG. 7 is a partial sectional schematic view of the movable rod and a fixing rod of the multifunctional chair of the present disclosure. In each of the pedal assemblies 4 of a practical embodiment, the movable rod 42 can have two retaining holes 421, the fixing rod 41 can have a retaining hole 411, and the user can use a pin S to penetrate through one of the retaining holes 421 of the movable rod 42 and the retaining hole 411 of the fixing rod 41, so that the movable rod 42 cannot move relative to the fixing rod 41. It should be noted that, the manner in which the movable rod 42 and the fixing rod 41 are fixed to each other is not limited to the above description and can be changed according to practical requirements. Naturally, in other embodiments, the pin S can be replaced by a component such as a screw.

As shown in FIG. 3, FIG. 5, and FIG. 7, in each of the pedal assemblies 4, when the pin S penetrates through one of the retaining holes 421 of the movable rod 42 and the retaining hole 411 of the fixing rod 41, the corresponding one of the operation portions 43 protrudes from the front edge 3A (as shown in FIG. 5) of the seat board structure 31. Conversely, when the pin S penetrates through another one of the retaining holes 421 and the retaining hole 411 of the fixing rod 41, the corresponding one of the operation portions 43 does not protrude from the front edge 3A (as shown in FIG. 5) of the seat board structure 31. In other words, the retaining holes 421 of the movable rods 42, the retaining hole 411 of the fixing rod 41, and the pin S are primarily in cooperation with each other, so that the corresponding one of the operation portions 43 protrudes from the front edge 3A of the seat board structure 31 or not. Naturally, whether or not the operation portion 43 protrudes from the front edge 3A of the seat board structure 31 is not limited by the design of the present disclosure.

Figure 8:
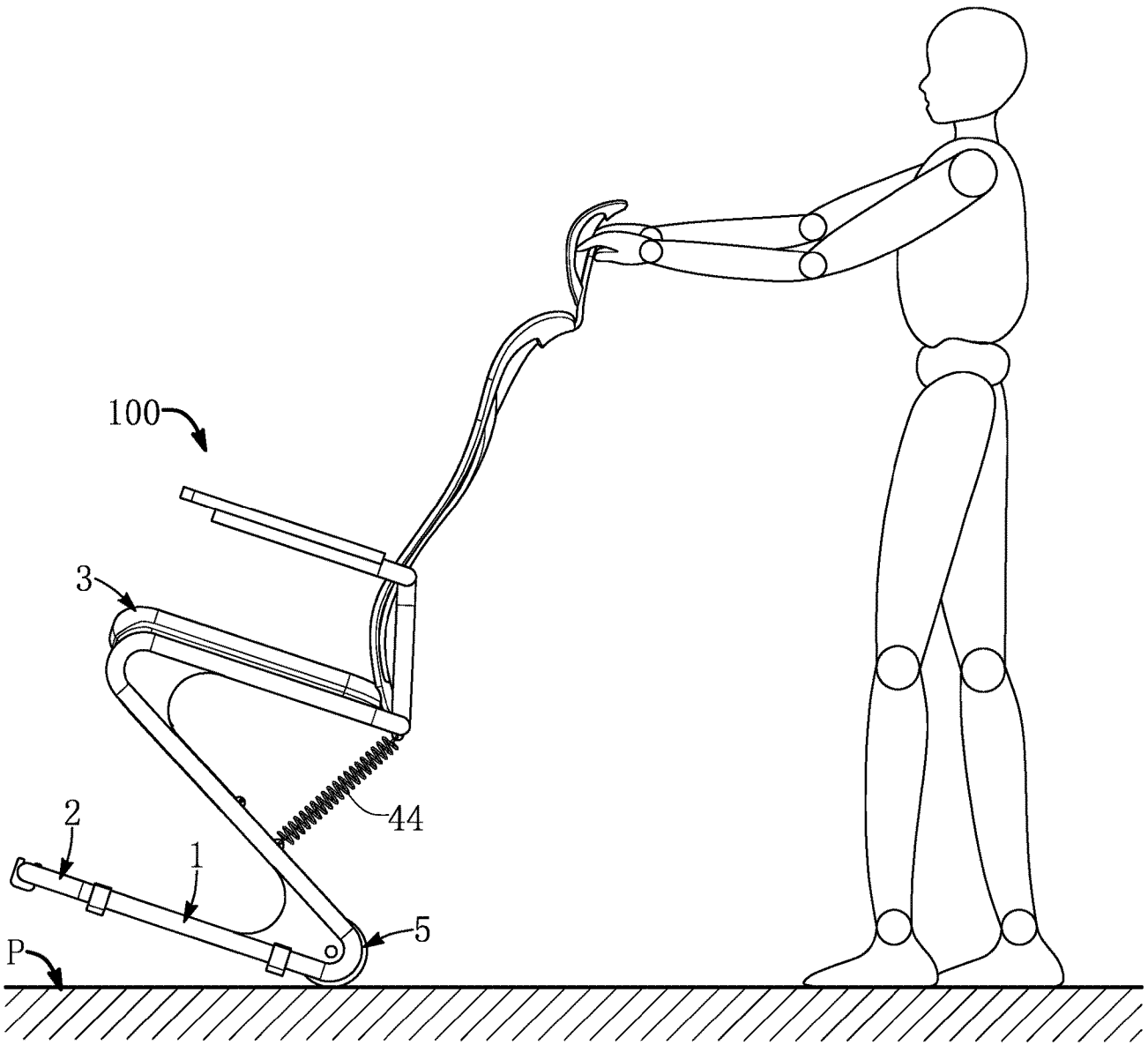
FIG. 8 is a schematic side view showing the multifunctional chair sliding through an auxiliary wheel according to the present disclosure.

Referring to FIG. 2, FIG. 3, and FIG. 8, FIG. 8 is a schematic side view showing the multifunctional chair sliding through an auxiliary wheel according to the present disclosure. A rear end of the placement portion 11 of the supporting body 1 can be pivotally connected to two auxiliary wheels 5, and each of the auxiliary wheels 5 is configured to rotate relative to the supporting body 1. As shown in FIG. 3, when the placement portion 1 is placed on the ground P, each of the auxiliary wheels 5 is not in contact with the ground P. As shown in FIG. 8, when the user tilts the multifunctional chair 100, the two auxiliary wheels 5 are in contact with the ground P, and the user can easily slide the multifunctional chair 100 by the two auxiliary wheels 5.

In other words, generally, when the user sits on the multifunctional chair 100, since each of the auxiliary wheels 5 is not in contact with the ground P, the multifunctional chair 100 can be stably placed on the ground P. When the user utilizes the multifunctional chair 100 to do exercise, since each of the auxiliary wheels 5 is not in contact with the ground P, the multifunctional chair 100 does not move.

According to the above, referring to FIG. 2 and FIG. 3, in an embodiment, the multifunctional chair 100 can further include a plurality of auxiliary fixing components 7. The auxiliary fixing components 7 are fixed to the placement portion 11, and the placement portion 11 is placed on the ground P through the auxiliary fixing components 7. When the supporting body 1 is placed on the ground P through the auxiliary fixing components 7, a gap G1 is between the supporting body 1 and the ground P, and a gap G2 is between each of the auxiliary wheels 5 and the ground P. Each of the auxiliary fixing components 7 can be, for example, made of a rubber material, and each of the auxiliary fixing components 7 can allow the supporting body 1 to be more stably placed on the ground P.

Figure 9:
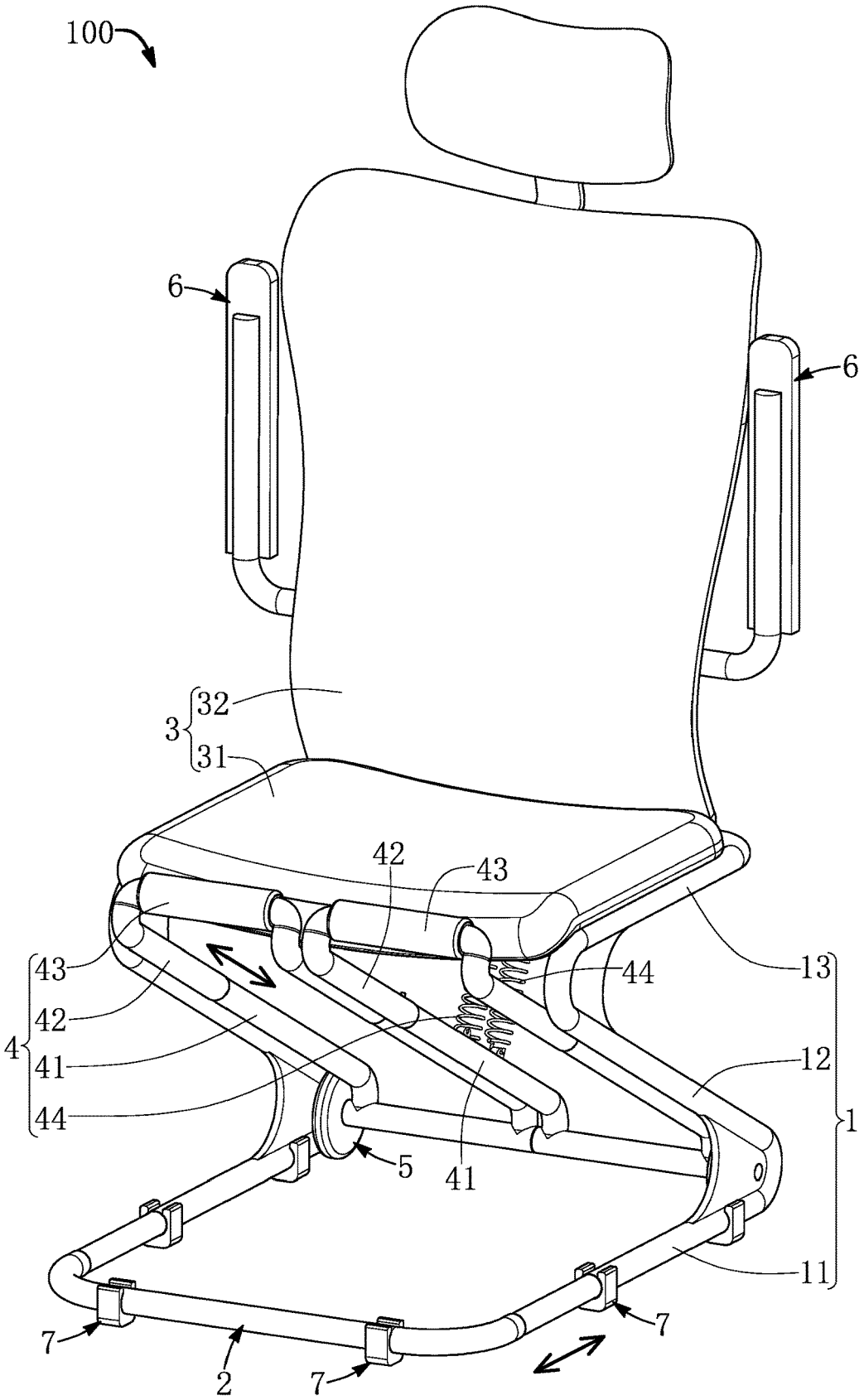
FIG. 9 is a schematic view showing two armrest structures of the multifunction chair that have been operated according to the present disclosure.
Figure 10:
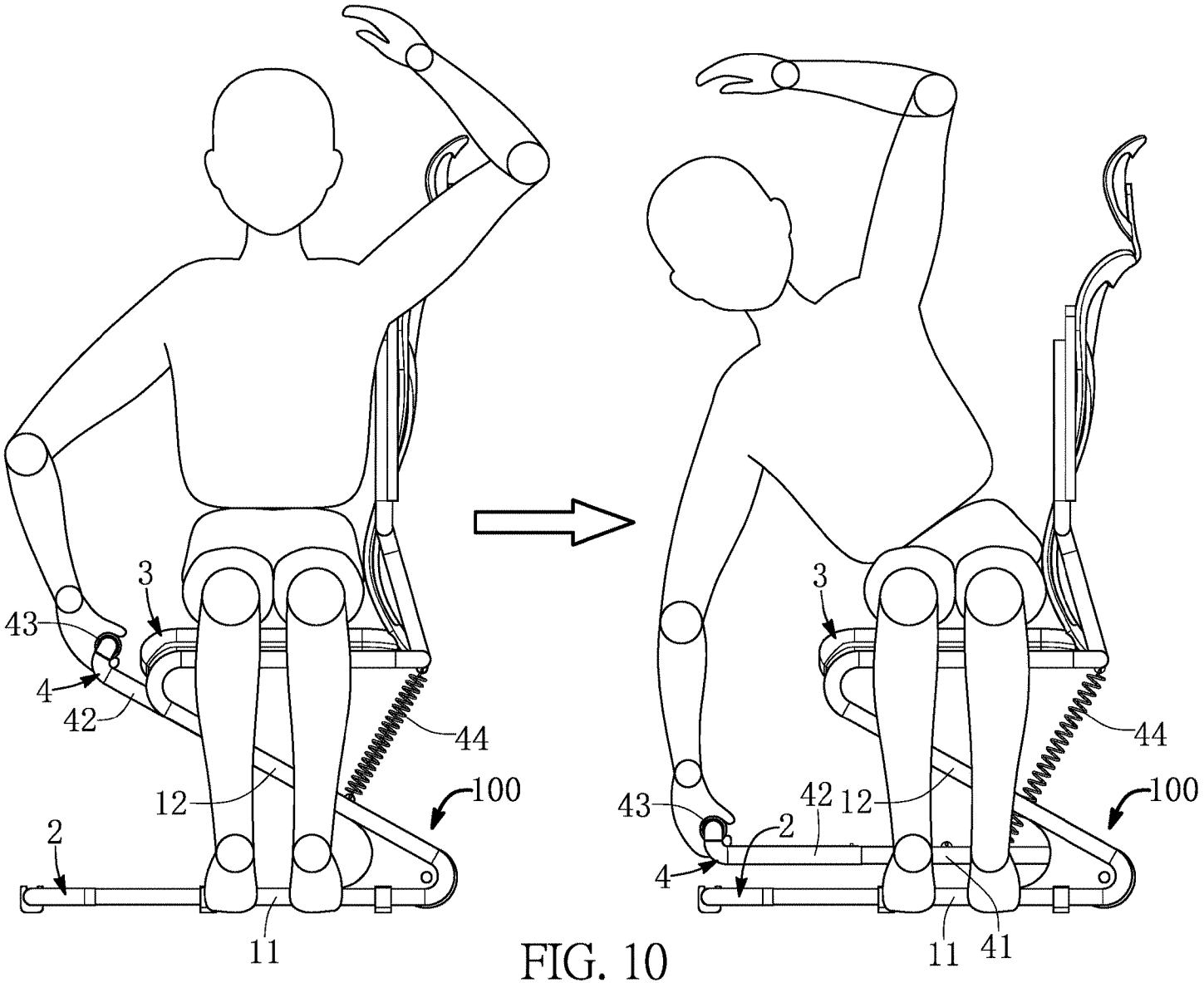
FIG. 10 is another schematic view showing the user utilizing the multifunctional chair to do exercise according to the present disclosure.

Referring to FIG. 2, FIG. 9, and FIG. 10, FIG. 9 is a schematic view showing two armrest structures of the multifunction chair that have been operated according to the present disclosure, and FIG. 10 is another schematic view showing the user utilizing the multifunctional chair to do exercise according to the present disclosure. As shown in FIG. 2 and FIG. 9, the two armrest structures 6 are respectively and movably connected to the supporting body 1, and each of the armrest structures 6 can be operated to rotate in a direction toward the backrest structure 32 or in a direction away from the backrest structure 32. In a practical application, each of the armrest structures 6 can be operated to rotate clockwise or counterclockwise for 90 degrees.

As shown in FIG. 9 and FIG. 10, after the user rotates the two armrest structures 6 for 90 degrees relative to the supporting body 1 and allows the operation portions 43 to protrude from the front edge 3A of the seat board structure 31, the user can laterally sit on the seat board structure 31, and the user can operate one of the operation portions 43 with the right hand to do exercise, so that the user can perform body stretching. Conversely, if the user wants to operate the operation portion 43 with the left hand, the user only has to reversely sit on the seat body 3, and the user can operate one of the operation portions 43 with left hand.

Figure 11:
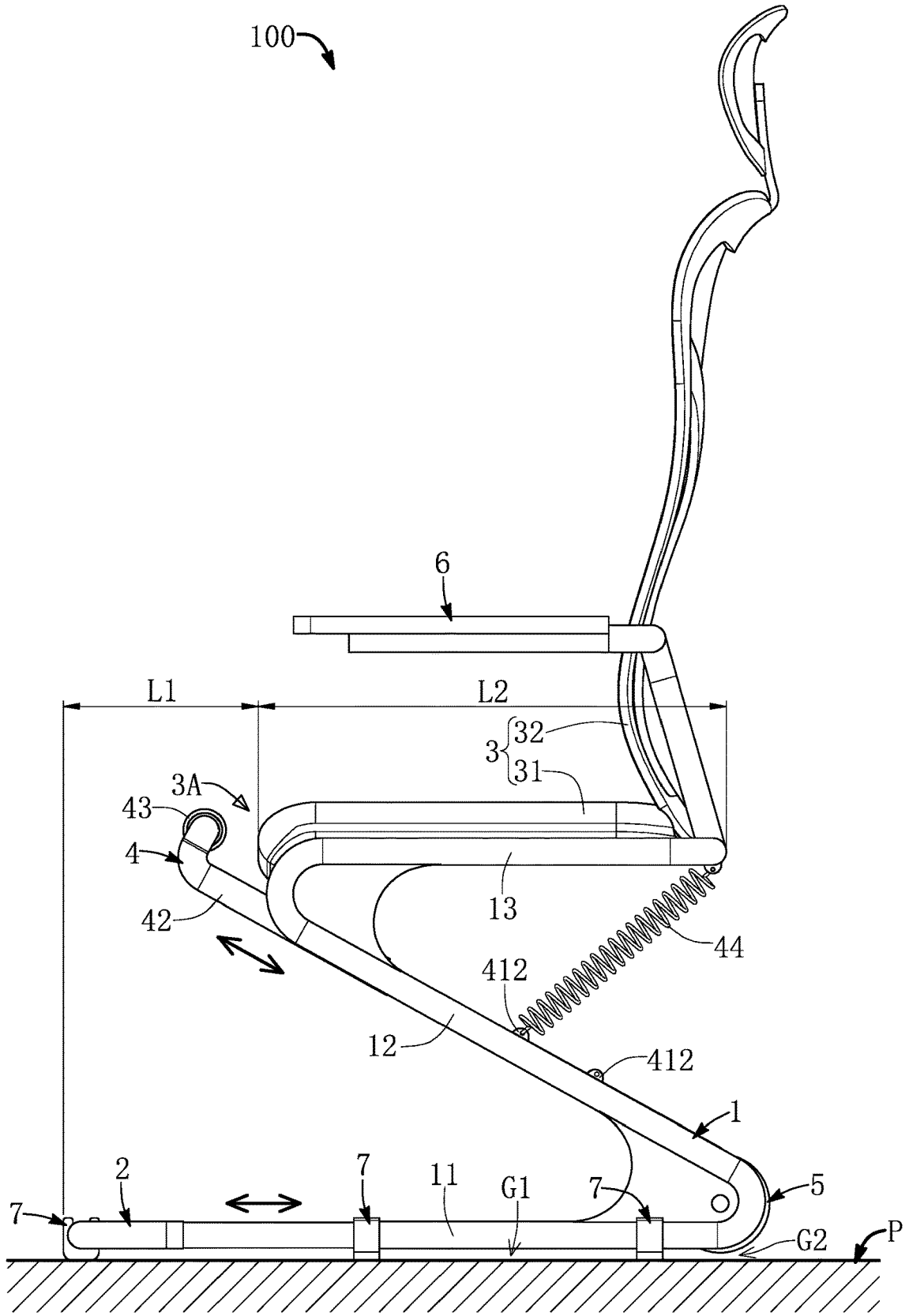
FIG. 11 is a schematic side view of the multifunction chair according to another embodiment of the present disclosure.

Referring to FIG. 11, FIG. 11 is a schematic side view of the multifunction chair according to another embodiment of the present disclosure. In a practical application, in each of the pedal assemblies 4, the fixing rod 41 can include two fixing structures 412, and one end of one of the elastic resistance members 44 is detachably fixed to one of the fixing structures 412. When the user allows the one end of the one of the elastic resistance members 44 to be fixed to different fixing structures 412, the user has to apply different force to rotate the operation portions 43 toward the ground P. Accordingly, different elastic resistance training requirements can be met.

Figure 12:
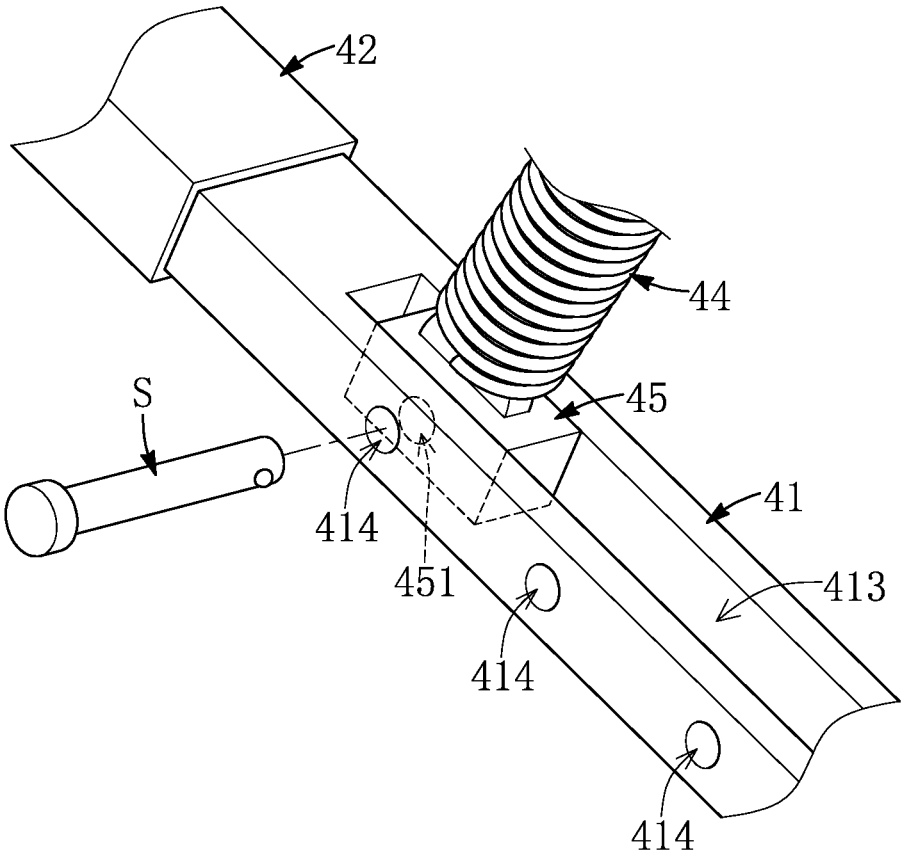
FIG. 12 is a partial enlarged schematic view showing that the fixing rod and an elastic resistance member of the multifunctional chair are connected to each other according to an embodiment of the present disclosure.

Referring to FIG. 12, FIG. 12 is a partial enlarged schematic view showing that the fixing rod and an elastic resistance member of the multifunctional chair are connected to each other according to an embodiment of the present disclosure. In a practical application, a side wall of the fixing rod 41 of each of the pedal assemblies 4 is recessed to form a sliding slot 413, the fixing rod 41 has a plurality of retaining holes 414 on the side wall having the sliding slot 413 formed thereon, and the sliding slot 413 has a slider 45 disposed therein. The one end of the elastic resistance member 44 is fixed to the slider 45, and the slider 45 can slide in the sliding slot 413. The slider 45 has a thru-hole 451, and the thru-hole 451 penetrates through the slider 45.

The user can utilize a pin S to penetrate through one of the retaining holes 414 and the thru-hole 451 of the slider 45, so that the slider 45 cannot move relative to the fixing rod 41, thereby changing a position where one of the elastic resistance members 44 and the fixing rod 41 are fixed with each other. In other words, by the design of the slider 45, the sliding slot 413, and the pin S, the user can change the position where one of the elastic resistance members 44 and the fixing rod 41 are fixed with each other through a simple operation according to requirements for a degree of elastic resistance. Naturally, the pin S can also be replaced by a component such as a screw in other embodiments.

Beneficial Effects of the Embodiment

In conclusion, the multifunctional chair of the present disclosure can be used by the user as a normal office chair, and can also be utilized to do exercise through a simple operation.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A multifunctional chair, comprising:

a supporting body including a placement portion, wherein the placement portion is configured to be placed on a ground surface;

a telescopic structure movably connected to the placement portion, wherein the telescopic structure is configured to move relative to the supporting body in a direction away from the supporting body or in a direction toward the supporting body;

a seat body fixed to a fixing portion of the supporting body; and at least one pedal assembly including:

a fixing rod having one end pivotally connected to the supporting body;

a movable rod movably connected to the fixing rod, wherein the movable rod is configured to move relative to the fixing rod;

an operation portion disposed at one end of the movable rod away from the fixing rod; and an elastic resistance member having two ends respectively fixed to the supporting body and the fixing rod, wherein the operation portion is configured to be operated such that the movable rod and the fixing rod rotate relative to the supporting body, and the elastic resistance member is configured to provide an elastic resistance, wherein the movable rod is configured to move relative to the fixing rod such that the operation portion is stored below the seat body, and the operation portion does not protrude from a front edge of the seat body, and wherein the at least one pedal assembly is configured to be disposed near the front edge of the seat body, so that the operation portion is provided to be abutted by the feet, a left hand, or a right hand of a user seated on the seat body.

2. The multifunctional chair according to claim 1, wherein the at least one pedal assembly comprises two pedal assemblies, and wherein each of the two pedal assemblies is configured to be operated to move relative to the supporting body independently from the other of the two pedal assemblies.

3. The multifunctional chair according to claim 1, further comprising two armrest structures, wherein the seat body includes a seat board structure and a backrest structure, a rear edge of the seat board structure is connected to the backrest structure, the two armrest structures are movably connected to the supporting body, and each of the armrest structures is configured to be operated to rotate in a direction toward the backrest structure or in a direction away from the backrest structure.

4. The multifunctional chair according to claim 3, wherein the telescopic structure is configured to be operated to protrude from the front edge of the seat body, and a length of the telescopic structure protruding from the front edge of the seat body is greater than or equal to one third of a length of the seat board structure.

5. The multifunctional chair according to claim 1, wherein the placement portion further includes at least two auxiliary wheels pivotally connected to a rear end thereof, and when the placement portion is placed on the ground surface, each of the auxiliary wheels is not in contact with the ground surface.

6. The multifunctional chair according to claim 5, further comprising a plurality of auxiliary fixing components fixed to the placement portion; wherein the placement portion is placed on the ground surface through the plurality of auxiliary fixing components; and wherein, when the placement portion is placed on the ground surface through the plurality of auxiliary fixing components, the supporting body is spaced apart from the ground surface by a first gap, and each of the auxiliary wheels is spaced apart from the ground surface by a second gap.

7. The multifunctional chair according to claim 1, wherein the fixing rod includes two fixing structures, one end of the elastic resistance member is configured to be operated to be fixed to any one of the fixing structures, one of the fixing structures is disposed near the seat body, and the other of the fixing structures is disposed away from the seat body.

8. The multifunctional chair according to claim 1, wherein a side wall of the fixing rod is recessed to form a sliding slot, the fixing rod has a plurality of retaining holes on the side wall having the sliding slot formed thereon, a slider is disposed in the sliding slot, one end of the elastic resistance member is fixed to the slider, the slider is configured to slide in the sliding slot, and the slider has a thru-hole; wherein the at least one pedal assembly includes a pin, and the pin is configured to be operated to pass through one of the plurality of retaining holes and the thru-hole, so as to retain a movement range of the slider in the sliding slot.

9. The multifunctional chair according to claim 1, wherein the movable rod has two retaining holes, the fixing rod has a retaining hole, the at least one pedal assembly further includes a pin, and the pin is configured to pass through one of the retaining holes of the movable rod and the retaining hole of the fixing rod, so as to retain a movement range of the movable rod relative to the fixing rod; and wherein, when the pin passes through the one of the retaining holes of the movable rod and the retaining hole of the fixing rod, the operation portion protrudes from the front edge of the seat body, and when the pin passes through the other of the retaining holes of the movable rod and the retaining hole of the fixing rod, the operation portion does not protrude from the front edge of the seat body.

10. The multifunctional chair according to claim 1, wherein the supporting body includes two inclined rods, and two ends of each of the inclined rods are respectively connected to the placement portion and the fixing portion.

* * * * *